US005140131A

United States Patent [19]

Macher et al.

[11] Patent Number: 5,140,131

[45] Date of Patent: Aug. 18, 1992

[54] ELECTRICAL HEATER FOR FOOTWEAR

[75] Inventors: David G. Macher, Voitsberg; Heinz H. Zorn, Eggersdorf, both of Austria

[73] Assignee: Albin Koch, Davos, Switzerland

[21] Appl. No.: 641,137

[22] Filed: Jan. 15, 1991

[51] Int. Cl.[5] ..... H05B 3/34

[52] U.S. Cl. ..... 219/211; 219/529

[58] Field of Search ..... 219/211, 528, 529, 549, 219/527

[56] References Cited

U.S. PATENT DOCUMENTS

| | | | |
|---|---|---|---|
| 2,028,347 | 1/1936 | Felosi | 219/211 |
| 2,298,299 | 10/1942 | Joy et al. | 219/211 |
| 2,692,326 | 10/1954 | Crowell | 219/211 |
| 2,858,410 | 10/1958 | Rich | 219/529 |
| 3,293,405 | 12/1966 | Costanzo | 219/211 |
| 3,663,796 | 5/1972 | Hines et al. | 219/211 |
| 3,906,185 | 9/1975 | Gross | 219/211 |
| 3,946,193 | 3/1976 | Giese | 219/211 |
| 4,080,971 | 3/1978 | Leeper | 36/2.6 |
| 4,250,398 | 2/1981 | Ellis | 219/528 |
| 4,665,301 | 5/1987 | Bondy | 219/211 |

FOREIGN PATENT DOCUMENTS

| | | |
|---|---|---|
| 383478B | 12/1986 | Austria . |
| 386830 | 12/1923 | Fed. Rep. of Germany . |

*Primary Examiner*—Teresa J. Walberg

*Attorney, Agent, or Firm*—Roylance, Abrams, Berdo & Goodman

[57] ABSTRACT

An electrical heater for footwear which is battery-powered and insertable into the footwear. The electrical heater includes a heatable insole, an electrical conductor, and a battery pack. The heatable insole includes an upper outer fabric layer, a heater insert assembly, and a lower outer rubber layer. The heater insert assembly is very thin and flexible and includes highly heat conductive top and bottom layers with a central layer sandwiched therebetween and having a heat conduction coefficient less than the heat conduction coefficients of the top and bottom layers, therefore acting as a momentary heat dam and storage core. A heating element is coupled to the bottom layer and has a surface area considerably smaller than the surface area of the bottom layer.

26 Claims, 2 Drawing Sheets

ELECTRICAL HEATER FOR FOOTWEAR

FIELD OF THE INVENTION

The invention relates to devices for heating footwear such as ski and work boots. The device comprises a battery-powered electrical heater assembly which is inserted into the boot and supported on the top of the insole.

BACKGROUND OF THE INVENTION

Numerous heating devices, typically electrical and battery-powered, are known for heating ski boots and work boots to provide comfort to the wearer, who is required or desires to be out of doors in cold weather for an extended period of time. While these devices have been known for many years, many have significant drawbacks and disadvantages. For example, some of these devices do not distribute the heat evenly, resulting in hot spots which may damage the wearer's skin. In addition, many of these devices do not provide a substantially continuous flow of heat, and therefore, the wearer's feet periodically experience coldness or discomfort. Moreover, these devices tend not to provide any heat storage capacity and thereby require extensive battery use which quickly drains the batteries. Finally, many of these prior devices are relatively bulky and complicated and costly to make, are not sufficiently flexible, and are not sufficiently corrosion proof when exposed to human perspiration.

Examples of these prior devices are disclosed in the following U.S. Pat. Nos.: 2,298,299 to Joy et al; 3,293,405 to Costanzo; 3,663,796 to Hines et al; 3,906,185 to Gross et al; 3,946,193 to Giese; 4,080,971 to Leeper; and 4,665,301 to Bondy; and in Austrian patent 383,478B to Macher and Zorn, and German patent 386830, the disclosures of which are hereby incorporated herein by reference.

SUMMARY OF THE INVENTION

Accordingly, a primary object of the invention is to provide an electrical heater for footwear that distributes heat evenly and substantially continuously and is also capable of storing heat derived from a battery.

A further object of the invention is to provide an electrical heater for footwear which is compact, flexible, relatively corrosion proof, and relatively uncomplicated and inexpensive to manufacture.

The foregoing objects are basically attained by providing an electrical heater assembly for footwear, the combination comprising an insert assembly for insertion into footwear and including a bottom heat conductive and flexible layer, a central heat conductive and flexible layer engaging the bottom layer, a top heat conductive and flexible layer engaging the central layer, and an electrical heating element located below and engaging the bottom layer, the central layer having a heat conducting coefficient less than the heat conduction coefficient of the bottom layer; a source of electrical energy; and a mechanism, coupled to the source of electrical energy and the heating element, for conducting electrical energy to the electrical heating element.

Other objects, advantages and salient features of the invention will become apparent from the following detailed description, which, taken in conjunction with the annexed drawings, discloses a preferred embodiment of the invention.

BRIEF DESCRIPTION OF THE DRAWINGS

Referring to the drawings which form a part of this original disclosure.

DETAILED DESCRIPTION OF THE INVENTION

Figure 1:
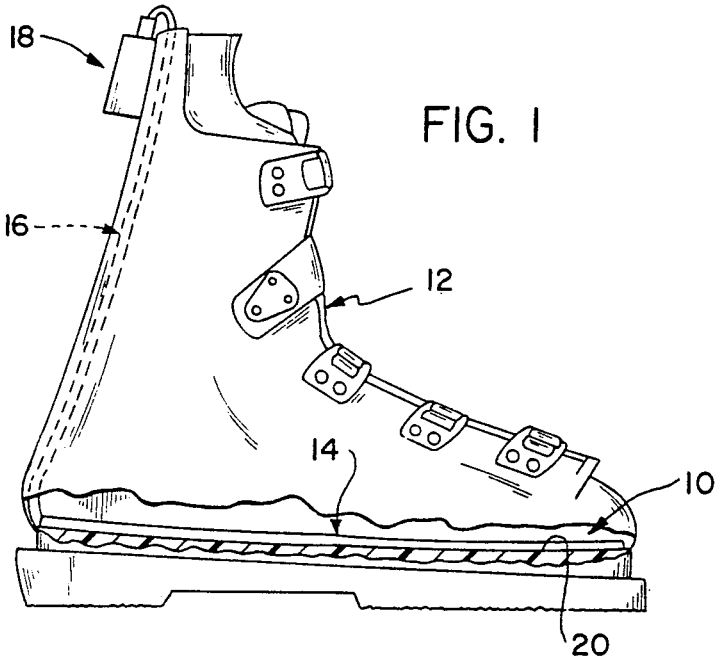
FIG. 1 is a side elevational view in partial section showing the electrical heater assembly in accordance with the invention located inside a left ski boot.

Referring to FIGS. 1–7, the electrical heater assembly 10 in accordance with the invention is positioned, for example, in a ski boot 12 and comprises a heatable insole 14, an electrical conductor 16, and a battery pack 18.

The electrical heater assembly 10 as seen in FIG. 1 has the heatable insole 14 located inside the boot 12 and sitting on the boot insole 20, with the electrical conductor 16 coupled thereto and extending upwardly and out of the boot and in electrical connection with the battery pack 18, which is suitably supported on the boot, such as by a clip.

As seen in FIGS. 2–7, the heatable insole 14 comprises an upper outer layer 22, a heater insert assembly 24, a lower outer layer 26, and an adhesive layer 28.

Figure 2:
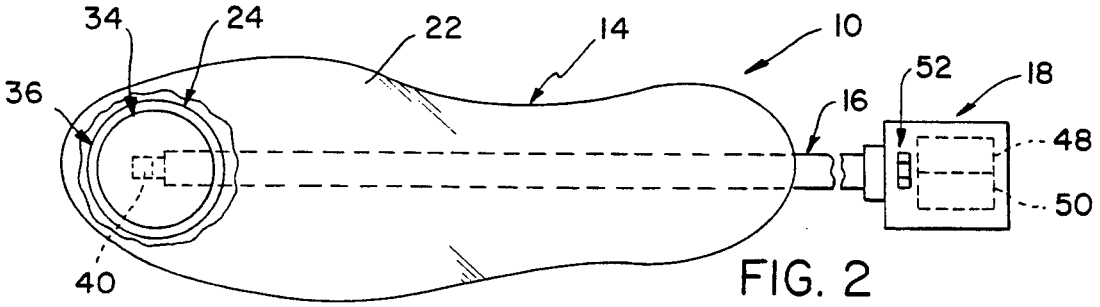
FIG. 2 is a top plan view of the electrical heater assembly in accordance with the invention with parts broken away for clarity.
Figure 3:
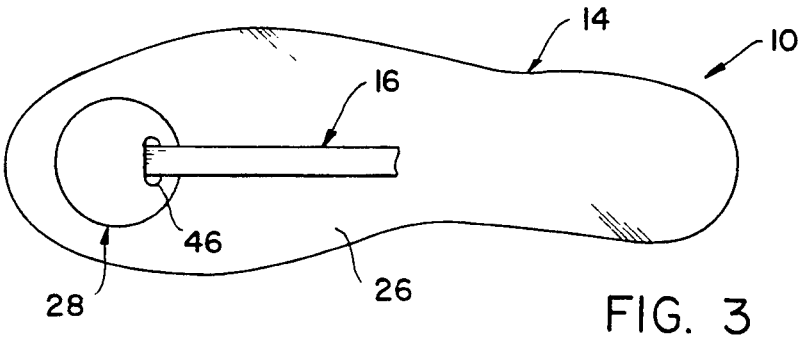
FIG. 3 is a bottom plan view of the electrical heater assembly shown in FIGS. 1 and 2 in accordance with the invention.
Figure 4:
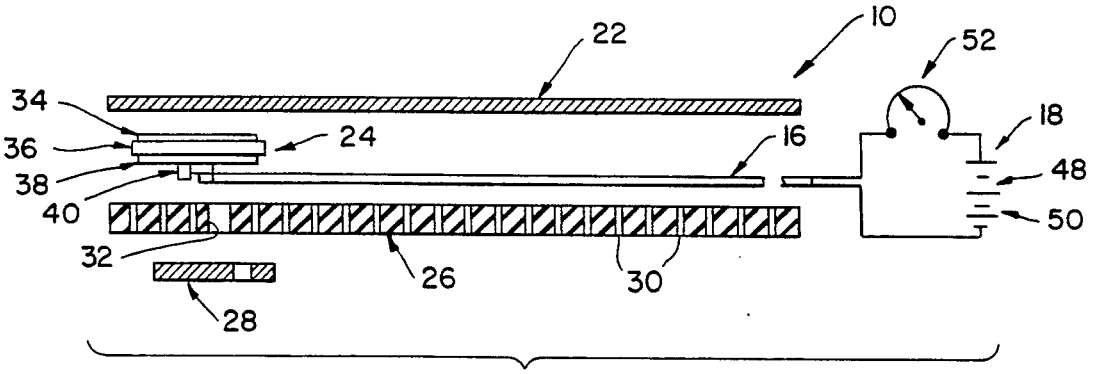
FIG. 4 is an exploded diagrammatical side elevational view of the electrical heater assembly shown in FIGS. 1–3 in partial section with the dimensions of the heater insert assembly not being to scale.

The electrical heater assembly 10 has an overall thickness of about 5/64 inch or about 2.0 millimeters with the upper outer layer preferably being formed of fabric and having a thickness of about 1/64 inch or about 0.40 millimeters, and the lower outer layer 26 preferably being formed of rubber and having a thickness of about 4/64 inch or about 1.60 millimeters, the upper and lower outer layers advantageously being coupled together via adhesive, not shown, or any other suitable connecting mechanism with the heater insert assembly 24 sandwiched therebetween. The lower outer layer 26 has a plurality of vertical perforations 30 to allow moisture to pass therethrough, and has an aperture 32 as seen in FIG. 4 through which the electrical conductor 16 can pass. The outer configuration of the upper and lower outer layers 22 and 26 as seen in FIGS. 2 and 3 approximate the outer configuration of the ski boot insole 20.

The heater insert assembly 24 comprises a top layer 34, a central layer 36, and a bottom layer 38 which are coupled together in series by means of, for example, fusing them together or using other suitable connecting mechanisms. The top layer 34 is flexible and substantially highly heat conductive, is circular in configuration and preferably is formed of a metal such as copper having a heat conductive coefficient to about 92.

The bottom layer 38 is substantially the same as the top layer 34 and is likewise flexible and substantially highly heat conductive, is configured as a circular disk, and is formed preferably of a metal such as copper having a heat conduction coefficient of about 92.

Figure 7:
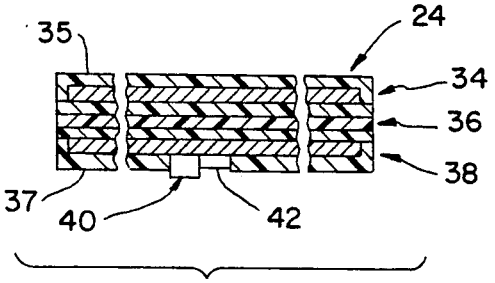
FIG. 7 is an enlarged side elevational view in longitudinal section of the heater insert assembly shown in FIGS. 2 and 4–6 without the electrical conductor coupled thereto and not to scale.

The center layer 36 is flexible and has a substantially low heat conduction coefficient and is preferably formed of laminations of fiberglass, three laminations being shown in FIG. 7, although more or fewer laminations can be used. The central layer has a heat conduction coefficient of about 0.20 to about 0.30. The central layer acts as a momentary heat dam and storage structure, which aids in distributing the heat derived from the battery pack laterally of the heater insert assembly 24.

The central layer 36 is also in a substantially circular configuration and has a diameter slightly larger than the diameters of the top and bottom layers 34 and 38, which are substantially the same. As seen in FIGS. 4 and 7, the central layer engages the top of the bottom layer and the bottom of the top layer, and any heat applied to the bottom layer will be conducted upwardly and outwardly therealong, as well as upwardly and outwardly along the central and top layers.

As seen in FIGS. 2 and 4–7, rigidly coupled to the bottom layer 38 is an electrical heating element 40 which includes, for example, a resistor in the form of, for example, an integrated circuit or microchip which is heated via the battery pack. The heating element has at least a pair of electrical contacts 42 and 44 extending therefrom for electrical connection with the electrical conductor 16. Advantageously, the total surface area of the heatable portion, i.e., the resistor, in the electrical heating element 40 is substantially 1/2500 the total surface area of each of the top and bottom layers 34 and 38. The heating element can be, for example, of the type used in Austrian patent 383,478B.

Figure 5:
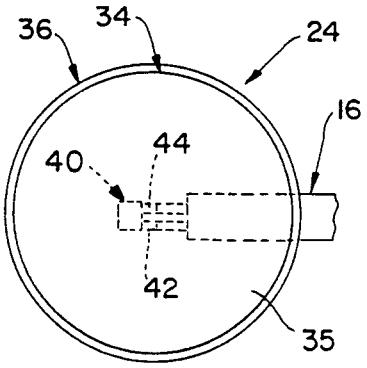
FIG. 5 is an enlarged top plan view of the heater insert assembly shown in FIGS. 2 and 4 with an electrical conductor coupled thereto.
Figure 6:
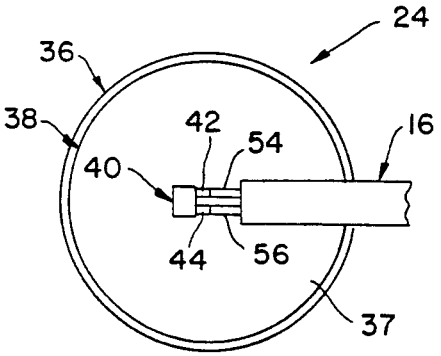
FIG. 6 is a bottom plan view of the heater insert assembly and electrical conductor shown in FIG. 5.

Advantageously, as seen in FIGS. 5 and 6, the outer diameter of the heater insert assembly 24 is about 2.125 inch or about 54 millimeters, and its thickness is about 1/64 inch or about 0.40 millimeters, with each of the top and bottom layers having a thickness of about 0.003–0.004 inch or about 0.076–0.101 millimeters, and the central layer having a thickness of about 2.5 times the thickness of the top or bottom layer comprising about 0.008–0.009 inch or about 0.203–0.228 millimeters. The outer dimensions of the electrical heating element 40 are about 1/16 inch or about 1.59 millimeters in thickness, about 6/64 inch or about 2.38 millimeters in width, and about 12/64 inch or about 4.76 millimeters in length.

Advantageously, the heater insert assembly 24, as seen in FIG. 7, can also comprise a first thin coating of water-resistant material 35, such as lacquer, applied to top layer 34 and the adjacent periphery of central layer 36, and a second thin coating of water-resistant material 37, such as lacquer, applied to bottom layer 38 and the adjacent periphery of central layer 36. These coatings resist corrosion of the top and bottom layers, particularly from perspiration, and can be transparent, but will not degrade under heating nor interfere with heat conduction of the heater insert assembly 24.

As seen in FIG. 3, adhesive layer 28 has an aperture 46 therein which receives the electrical conductor 16, the adhesive layer 28 being adhered to the bottom surface of the lower outer layer 26, by use of any suitable adhesive.

The battery pack 18 contains, for example, two batteries 48 and 50, as seen in FIGS. 2 and 4, and serves as a source of electrical energy for the heating element 40. The batteries are electrically connected to the electrical conductor 16 with a rheostat 52 in the circuit to allow the wearer to adjust the amount of current and therefore heat provided to the heating element from the batteries.

Electrically connecting the batteries and rheostat to the electrical heating element is the electrical conductor 16 which has contacts 54 and 56 at its end as seen in FIG. 6 which are suitably electrically coupled to contacts 42 and 44 on the electrical heating element, such as by soldering.

In operation, when heating is desired, the wearer manipulates the rheostat 52 to provide electrical current from the batteries along the conductor 16 and to the heating element 40 in the heater insert assembly 24.

The resistor in heating element 40 heats up and the heat therefrom is conducted directly to the bottom layer 38 to which it is coupled. This bottom layer 38 has a high heat conduction coefficient and thereby rapidly distributes the heat laterally and vertically through the bottom layer. Heat in the bottom layer will tend to spread toward the cooler central layer 36 which will slowly absorb the heat and slowly spread it laterally and vertically therethrough, since the central layer has a lower heat conduction coefficient. However, after the heat has spread in the central layer, it eventually passes vertically through the central layer and is conducted to the top layer 34, where it again is evenly distributed therethrough. From the now heated top layer 34, the heat then is capable of warming the wearer's foot as it passes via convection and radiation through the fabric upper outer layer 22 and into contact with the wearer's foot which is positioned on top of the upper outer layer.

While a particular embodiment has been chosen to illustrate the invention, it will be understood by those skilled in the art that various changes and modifications can be made therein without departing from the scope of the invention as defined in the appended claims.

What is claimed is:

1. An electrical heater assembly for footwear, the combination comprising:

an insert assembly for insertion into footwear and including a bottom heat conductive and flexible layer, a central heat conductive and flexible layer engaging and fused to said bottom layer, a top heat conductive and flexible layer engaging and fused to said central layer, and an electrical heating element located below and engaging said bottom layer, said central layer having a heat conductive coefficient less than the heat conduction coefficient of said bottom layer;

a source of electrical energy; and means, coupled to said source of electrical energy and said heating element, for conducting electrical energy to said electrical heating element.

2. An electrical heater assembly according to claim 1, wherein said heating element has a surface area smaller than the surface area of said top layer.

3. An electrical heater assembly according to claim 1, wherein said central layer has a heat conduction coefficient of about 0.20 to about 0.30, and said bottom layer has a heat conduction coefficient of about 92.

4. An electrical heater assembly according to claim 3, wherein said top layer has a heat conduction coefficient of about 92.

5. An electrical heater assembly according to claim 1, wherein said top layer is formed of a metal, said central layer is formed of fiberglass, and said bottom layer is formed of a metal.

6. An electrical heater assembly according to claim 1, wherein said top layer is formed of copper, said central layer is formed of a plurality of laminations of fiberglass, and said bottom layer is formed of copper.

7. An electrical heater assembly according to claim 1, wherein said top layer has a surface area about 2,500 times larger than the surface area of the heatable portion of said heating element.

8. An electrical heater assembly according to claim 1, wherein said bottom layer has a surface area about 2,500 times larger than the surface area of the heatable portion of said heating element.

9. An electrical heater assembly according to claim 1, wherein said bottom, central and top layers have a combined thickness of about 0.40 millimeters.

10. An electrical heater assembly according to claim 9, wherein said insert assembly is substantially circular and has a diameter of about 54 millimeters.

11. An electrical heater assembly according to claim 1, and further comprising an upper outer layer engaging said top layer, and a lower outer layer engaging said bottom layer.

12. An electrical heater assembly according to claim 11, wherein said upper outer layer is formed of fabric, and said lower outer layer is formed of rubber.

13. An electrical heater assembly, the combination comprising:

a bottom heat conductive and flexible layer;

a central heat conductive and flexible layer engaging and fused to said bottom layer;

a top heat conductive and flexible layer engaging and fused to said central layer; and an electrical heating element located below and engaging said bottom layer, said central layer having a heat conductive coefficient less than the heat conductive coefficient of said bottom layer.

14. An electrical heater assembly according to claim 13, wherein said heating element has a surface area smaller than the surface area of said top layer.

15. An electrical heater assembly according to claim 13, wherein said central layer has a heat conduction coefficient of about 0.20 to about 0.30, and said bottom layer has a heat conduction coefficient of about 92.

16. An electrical heater assembly according to claim 15, wherein said top layer has a heat conduction coefficient of about 92.

17. An electrical heater assembly according to claim 13, wherein said top layer is formed of a metal, said central layer is formed of fiberglass, and said bottom layer is formed of a metal.

18. An electrical heater assembly according to claim 13, wherein said top layer is formed of copper, said central layer is formed of a plurality of laminations of fiberglass, and said bottom layer is formed of copper.

19. An electrical heater assembly according to claim 13, wherein said top layer has a surface area about 2,500 times larger than the surface area of the heatable portion of said heating element.

20. An electrical heater assembly according to claim 13, wherein said bottom layer has a surface area about 2,500 times larger than the surface area of the heatable portion of said heating element.

21. An electrical heater assembly according to claim 13, wherein said bottom, central and top layers have a combined thickness of about 0.40 millimeters.

22. An electrical heater assembly according to claim 13, and further comprising a first water-resistant coating applied to said top layer, and a second water-resistant coating applied to said bottom layer.

23. An electrical heater assembly for footwear, the combination comprising:

an insert assembly for insertion into footwear and including a bottom heat conductive and flexible layer, a central heat conductive and flexible layer engaging said bottom layer, a top heat conductive and flexible layer engaging said central layer, and an electrical heating element located below said bottom layer and engaging only the center of said bottom layer, said electrical heating element having a surface are considerably smaller than the surface area of said top layer, said central layer having a heat conduction coefficient less than the heat conduction coefficient of said bottom layer;

a source of electrical energy; and means, coupled to said source of electrical energy and said heating element, for conducting electrical energy to said electrical heating element.

24. An electrical heater assembly, the combination comprising:

a bottom heat conductive and flexible layer;

a central heat conductive and flexible layer engaging said bottom layer;

a top heat conductive and flexible layer engaging said central layer; and an electrical heating element located below said bottom layer and engaging only the center of said bottom layer, said electrical heating element having a surface area considerably smaller than the surface area of said top layer, sad central layer having a heat conduction coefficient less than the heat conduction coefficient of said bottom layer.

25. An electrical heater assembly for footwear, the combination comprising:

an insert assembly for insertion into footwear and including a bottom heat conductive and flexible layer, a central heat conductive, solid, and flexible layer engaging said bottom layer, a top heat conductive and flexible layer engaging said central layer, and an electrical heating element located below and engaging said bottom layer, said central layer having a heat conduction coefficient less than the heat conduction coefficient of said bottom layer;

a source of electrical energy; and means, coupled to said source of electrical energy and said heating element, for conducting electrical energy to said electrical heating element.

26. An electrical heater assembly, the combination comprising:

a bottom heat conductive and flexible layer;

a central heat conductive, solid, and flexible layer engaging said bottom layer;

a top heat conductive and flexible layer engaging said central layer; and an electrical heating element located below and engaging said bottom layer, said central layer having a heat conduction coefficient less than the heat conduction coefficient of said bottom layer.

* * * * *

UNITED STATES PATENT AND TRADEMARK OFFICE

CERTIFICATE OF CORRECTION

PATENT NO. : 5,140,131

DATED : August 18, 1992

INVENTOR(S) : David G. Macher and Heinz H. Zorn

It is certified that error appears in the above-identified patent and that said Letters Patent is hereby corrected as shown below:

Column 4, line 56, after "heat", delete "conductive" and insert --conduction--.

Column 5, line 56, after "heat", delete "conductive" and insert --conduction--.

Column 5, line 57, after "heat", delete "conductive" and insert --conduction--.

Column 6, line 48, delete "are" and insert --area--.

Signed and Sealed this

Twelfth Day of October, 1993

*Attest:*

*Attesting Officer*

BRUCE LEHMAN

*Commissioner of Patents and Trademarks*